US008433224B2

(12) United States Patent
Fujiwara et al.

(10) Patent No.: US 8,433,224 B2
(45) Date of Patent: Apr. 30, 2013

(54) DEVELOPMENT DEVICE, PROCESS CARTRIDGE INCLUDING SAME, AND IMAGE FORMING APPARATUS INCLUDING SAME

(75) Inventors: Yoshihiro Fujiwara, Kanagawa (JP); Yasuo Miyoshi, Kanagawa (JP); Hiroshi Hosokawa, Kanagawa (JP); Norio Kudo, Kanagawa (JP); Hiroaki Okamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 350 days.

(21) Appl. No.: 12/952,519

(22) Filed: Nov. 23, 2010

(65) Prior Publication Data

US 2011/0150525 A1 Jun. 23, 2011

(30) Foreign Application Priority Data

Dec. 22, 2009 (JP) ..... 2009-290420

(51) Int. Cl.
*G03G 15/08* (2006.01)

(52) U.S. Cl.
USPC ..... 399/254; 399/27; 399/355

(58) Field of Classification Search ..... 399/27, 399/255, 254, 355, 92
See application file for complete search history.

(56) References Cited

U.S. PATENT DOCUMENTS

| | | | | |
|---|---|---|---|---|
| 5,381,217 | A * | 1/1995 | Ishida | 399/120 |
| 5,845,183 | A | 12/1998 | Sugiyama et al. | |
| 6,505,014 | B2 | 1/2003 | Aoki et al. | |
| 6,671,484 | B2 | 12/2003 | Miyoshi et al. | |
| 6,721,516 | B2 | 4/2004 | Aoki et al. | |
| 6,901,233 | B2 | 5/2005 | Aoki et al. | |
| 7,035,575 | B2 | 4/2006 | Ikeguchi et al. | |
| 7,536,141 | B2 | 5/2009 | Miyoshi | |
| 7,599,649 | B2 | 10/2009 | Miyoshi | |
| 7,650,101 | B2 | 1/2010 | Hosokawa et al. | |
| 7,769,326 | B2 | 8/2010 | Miyoshi | |

(Continued)

FOREIGN PATENT DOCUMENTS

| | | |
|---|---|---|
| EP | 1 791 035 A1 | 5/2007 |
| JP | 2002-6599 | 1/2002 |
| JP | 2007-72347 | 3/2007 |
| JP | 2007-163933 A | 6/2007 |

OTHER PUBLICATIONS

Extended European Search Report issued Apr. 11, 2012, in European Patent Application No. 10192592.3.

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A development device includes a developer carrier, a supply compartment having a downstream end portion positioned outside the development area in the axial direction of the developer carrier, a collection compartment disposed lower than the supply compartment, first and second communication ports respectively formed in the downstream end portion and an upstream end portion of the supply compartment, a developer circulation unit including first and second developer conveyance members respectively provided in the supply compartment and the collection compartment, a toner supply port formed in an upper portion of the downstream end portion of the supply compartment, and an airflow path limiter provided in the downstream end portion of the supply compartment, closer to the development area than the toner supply port in the axial direction of the developer carrier, to restrict an airflow path above the developer in the downstream end portion of the supply compartment.

13 Claims, 10 Drawing Sheets

U.S. PATENT DOCUMENTS

2007/0122202 A1 5/2007 Taguma et al.
2008/0056747 A1 3/2008 Miyoshi
2009/0169264 A1 7/2009 Miyoshi et al.
2009/0220252 A1 * 9/2009 Onishi ..... 399/27
2009/0232558 A1 9/2009 Kudo et al.
2009/0238610 A1 9/2009 Miyoshi et al.
2010/0014895 A1 1/2010 Hosokawa et al.
2010/0202805 A1 8/2010 Miyoshi et al.
2010/0215401 A1 8/2010 Fujiwara et al.

* cited by examiner

DEVELOPMENT DEVICE, PROCESS CARTRIDGE INCLUDING SAME, AND IMAGE FORMING APPARATUS INCLUDING SAME

CROSS-REFERENCE TO RELATED APPLICATIONS

This patent specification is based on and claims priority from Japanese Patent Application No. 2009-290420, filed on Dec. 22, 2009 in the Japan Patent Office, which is hereby incorporated by reference herein in its entirety.

BACKGROUND OF THE INVENTION

1. Field of the Invention

The present invention generally relates to a development device using two-component developer consisting essentially of toner and carrier, a process cartridge including the same, and an image forming apparatus, such as a copier, a printer, a facsimile machine, or a multifunction machine having at least two of these capabilities, that includes the same.

2. Description of the Background Art

Two-component developer consisting essentially of toner and carrier is widely used in electrophotographic image forming apparatuses.

Development devices using two-component developer typically include a developer container in which developer is contained, a rotary developer carrier such as a development roller, and a developer conveyance member such as a conveyance screw provided in the developer container. The developer conveyance member supplies developer to the developer carrier while transporting the developer through a developer supply compartment (i.e., a developer supply path) in the developer container in an axial direction of the developer carrier. Then, the developer carrier rotates and supplies the developer carried thereon to a development area facing an image carrier such as a photoconductor. After having passed through the development area and toner therein has been consumed, the developer (hereinafter "used developer") is collected either in the supply compartment (hereinafter "one-conveyance path method") or a collection compartment separate from the supply compartment (hereinafter "supply-collection separation method).

The one-conveyance path method has a drawback in that the concentration of toner in the developer in the supply compartment decreases downstream in a direction in which the developer is transported (hereinafter "developer conveyance direction"), and accordingly the concentration of toner in the developer supplied to the development area is uneven in the axial direction of the developer carrier. Such unevenness in toner concentration causes unevenness in image density of images formed on sheets of recording media and is undesirable. It is to be noted that hereinafter "downstream" and "upstream" as used in this specification means downstream and upstream in the developer conveyance direction unless otherwise specified.

To solve the problem described above, for example, JP-2002-006599-A employs a supply-collection separation method in which used developer is collected in a collection compartment separate from the supply compartment (hereinafter "a supply-collection separation-type development device"). In the supply-collection separation-type development device, the concentration of toner in the developer in the supply compartment can be kept substantially constant in the developer conveyance direction. Although the concentration of toner in the developer supplied to the development area can be kept uniform in the axial direction of the developer carrier in the supply-collection separation-type development device, doing so makes it impossible to make such development devices compact. At present, it is preferred to make development devices more compact to make the image forming apparatus incorporating the development device compact.

Several approaches, such as those described below, have been tried to make supply-collection separation-type development devices compact. For example, a vertical agitation arrangement shown in FIG. 17 is effective to make supply-collection separation-type development devices compact. More specifically, in a known supply-collection separation-type development device 3Z shown in FIG. 17, a supply compartment 301SZ is disposed adjacent to and to one side of a developer carrier 302Z (in FIG. 17, in a lateral direction), and a collection compartment 301CZ is disposed beneath the supply compartment 301SZ. The collection compartment 301CZ receives developer that has been transported to a downstream end portion of the supply compartment 301SZ. In the development device 3Z, developer is circulated in the direction indicated by outlined arrows A1 and A2 shown in FIG. 17.

However, the vertical agitation arrangement has a limitation regarding the location of a toner supply mechanism for supplying toner to the development device. In the development device 3Z shown in FIG. 17, developer is transported from the downstream end portion of the supply compartment 301SZ to an upstream end portion of the collection compartment 301CZ and transported from a downstream end portion of the collection compartment 301CZ to an upstream end portion of the supply compartment 301SZ, thus forming a developer circulation path.

In the development device 3Z, as the location of a toner supply port 310Z through which toner is supplied to the developer circulating in the developer circulation path, a portion of the supply compartment 301SZ facing the development area of the developer carrier 302Z must be avoided. If toner is supplied to that portion, the toner just after supplied is likely to be carried by the developer carrier 302Z to the development area. Since electrical charge of the toner just after supplied is insufficient, such toner can scatter on the backgrounds of output images or around the interior of the image forming apparatus if being used in image development.

In view of the foregoing, it is preferred that the toner supply position be positioned further from the upstream end portion of the supply compartment 301SZ on the developer circulation path, outside the portion facing the development area of the developer carrier 302Z. Such an arrangement can increase contact between the supplied toner and carrier particles in the developer, thus charging the supplied toner better, before the supplied toner reaches the upstream end portion of the supply compartment 301SZ where the developer is carried onto the developer carrier 302Z.

Therefore, in supply-collection separation-type development devices, toner is typically supplied to the collection compartment 301CZ. However, to supply toner to the collection compartment 301CZ in the vertical agitation arrangement in which the collection compartment 301CZ is positioned beneath the supply compartment 301SZ, the arrangement is limited to the two arrangements described below.

In a first arrangement, as shown in FIG. 17, a toner supply route 350 is positioned on the side of the supply compartment 301SZ, opposite the developer carrier 302Z, and the toner supply port 310Z, which is at a downstream end of the toner supply route 350, is formed in a side wall of the collection compartment 301CZ positioned beneath the supply compartment 301SZ. This arrangement increases the size of the development device 3Z in the lateral direction in FIG. 17 by a length corresponding to the width of the toner supply route 350.

FIG. 18 illustrates a second arrangement regarding the location of the toner supply route. As shown in FIG. 18, in a development device 3Z1, a collection compartment 301CZ' is made longer than a supply compartment 301SZ' in the axial direction of a developer carrier 302Z, and a toner supply port 310Z is provided in the expanded portion of the collection compartment 301CZ. This arrangement increases the size of the development device 3Z1 in the axial direction of the developer carrier 302Z (in FIG. 18, the lateral direction) by a length corresponding to the width of the toner supply port 310Z.

As described above, in the vertical agitation arrangement in which the collection compartment is disposed beneath the supply compartment, the development device becomes bulkier when toner is supplied to the collection compartment, which is not desirable.

In view of the foregoing, the inventors of the present embodiment recognize that there is a need for the development device to reduce scattering of toner in the background of output images and around the interior of the image forming apparatus without increasing the size of the device.

SUMMARY OF THE INVENTION

In view of the foregoing, one illustrative embodiment of the present invention provides a development device to develop a latent image formed on a latent image carrier with developer. The development device includes a developer carrier disposed facing the latent image carrier, to carry the developer by rotation to a development area facing the latent image carrier, a partition dividing an interior of the development device into at least a supply compartment and a collection compartment both facing the developer carrier and extending in an axial direction of the developer carrier, a developer circulation unit to circulate the developer in the development device, a toner supply port formed in an upper portion of a downstream end portion of the supply compartment in a developer conveyance direction in which the developer is circulated, positioned outside the development area in an axial direction of the developer carrier, and an airflow path limiter provided in the downstream end portion of the supply compartment and positioned closer to the development area than the toner supply port in the axial direction of the developer carrier, to restrict an airflow path above the developer in the downstream end portion of the supply compartment.

The developer is supplied from the supply compartment to the developer carrier and is collected from the developer carrier to the collection compartment disposed lower than the supply compartment. To circulate the developer inside the development device, a first communication port is formed in a bottom portion of the downstream end portion of the supply compartment, and a second communication port is formed in an upstream end portion of the supply compartment. The developer circulation unit includes a first developer conveyance member provided in the supply compartment, to supply the developer to the developer carrier while transporting the developer through the supply compartment in the axial direction of the developer carrier and a second developer conveyance member disposed in the collection compartment that faces the developer carrier, to transport in the axial direction of the developer carrier the developer separated from the developer carrier.

Another illustrative embodiment provides a process cartridge that is removably installable in an image forming apparatus and including a latent image carrier on which a latent image is formed and the development device described above.

Yet another illustrative embodiment provides an image forming apparatus including a latent image carrier on which a latent image is formed and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
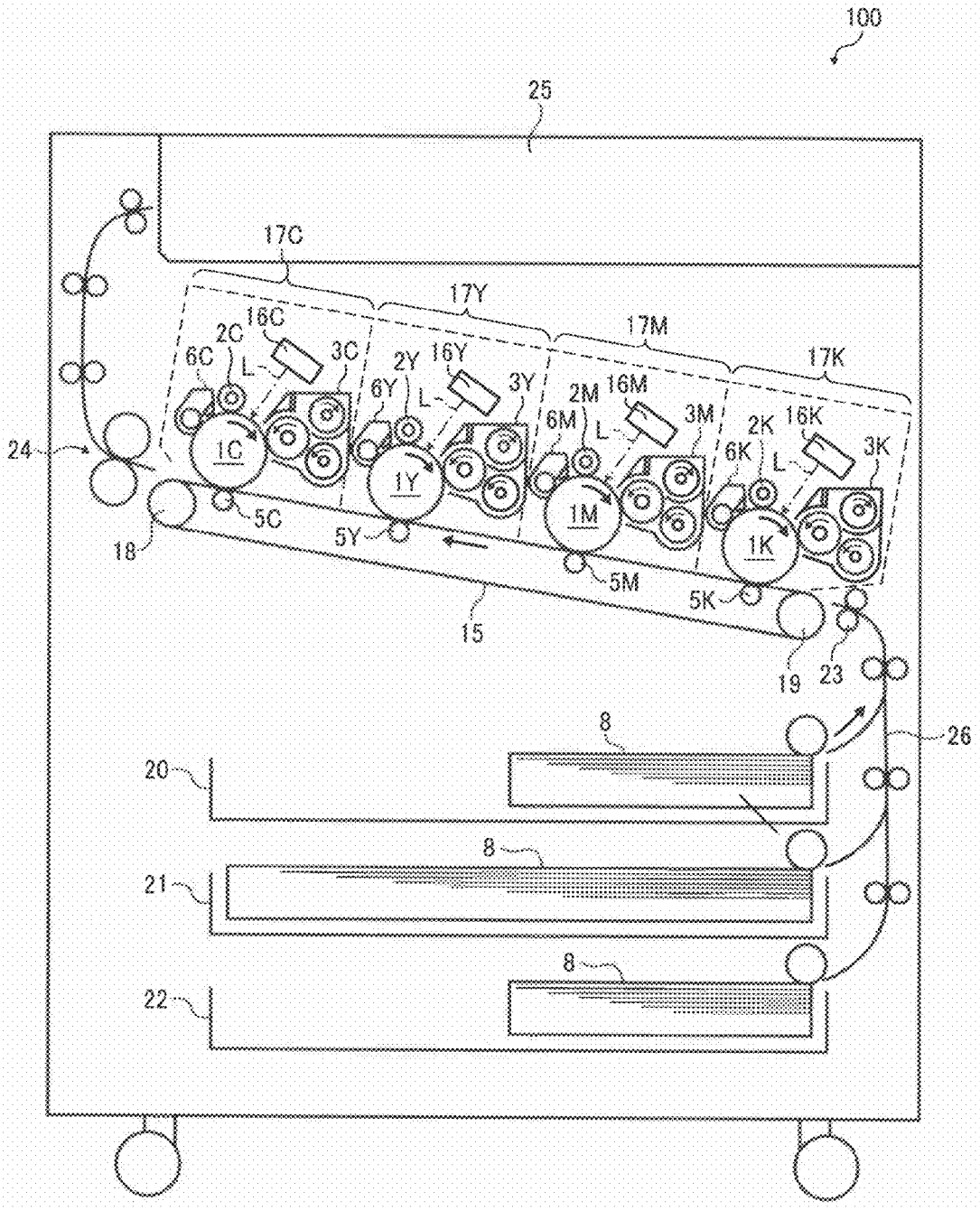
FIG. 1 is a schematic diagram of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

It is to be noted that the subscripts M, C, Y, and K attached to the end of each reference numeral indicate only that components indicated thereby are used for forming black, magenta, yellow, and cyan images, respectively, and hereinafter may be omitted when color discrimination is not necessary.

FIG. 1 is a schematic diagram of an image forming apparatus according to the present embodiment.

Referring to FIG. 1, an image forming apparatus 100 according to the present embodiment is a tandem-type printer (hereinafter also "printer 100") and includes multiple image forming units 17K, 17M, 17Y, and 17C arranged along a transport belt 15 that transports transfer sheets 8 (i.e., recording media). It is to be noted that arrangement order of the image forming units 17 is not limited to that shown in FIG. 1, and, for example, the image forming units 17 may be arranged in the order of magenta, cyan, yellow, and black with the image forming unit 17K disposed extreme downstream in a direction in which the transfer sheet 8 is transported.

Each image forming unit 17 includes a photoconductor 1 serving as a latent image carrier and forms black, magenta, yellow, or cyan images on the photoconductor 1. In the present embodiment, each image forming unit 17 includes multiple components housed in a common unit casing and is configured as a process cartridge removably installable in a main body of the printer 100 although it is not necessary that those components are united as a single unit. The image forming units 17K, 17M, 17Y, and 17C have a similar configuration except for the color of toner used therein.

The transport belt 15 is stretched around support rollers 18 and 19. One of the rollers 18 and 19 is a driving roller and the other is a driven roller. As the driving roller rotates, the transport belt 15 rotates in the direction indicated by an arrow shown in FIG. 1.

Additionally, sheet cassettes 20, 21, and 22 are provided beneath the transport belt 15, and a discharge tray 25 is provided on an upper surface of the main body of the printer 100.

The image forming unit 17 is described in further detail below.

Figure 2:
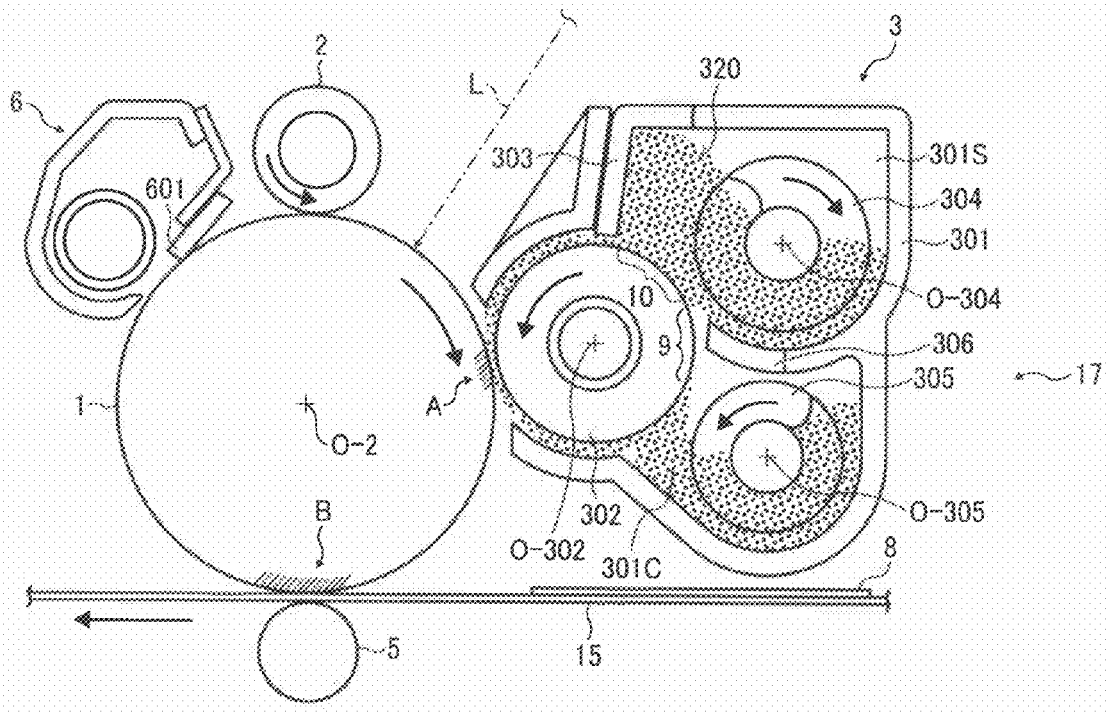
FIG. 2 in an end-on axial view of an image forming unit in the image forming apparatus shown in FIG. 1.

The photoconductor 1 rotates clockwise in FIG. 2. A charging roller of a charging device 2 is provided above the photoconductor 1. The charging device 2 in the present embodiment employs a contact-charging method, and the charging roller to which a charging bias is applied is disposed in contact with a circumferential surface of the photoconductor 1, thereby charging the photoconductor 1 uniformly to a predetermined electrical potential. Alternatively, a noncontact method may be adopted. Subsequently, the circumferential surface of the photoconductor 1 thus charged uniformly by the charging device 2 receives an optical beam L (i.e., a writing light) emitted from an exposure unit 16 shown in FIG. 1, and thus an electrostatic latent image is formed thereon.

In the present embodiment, the charging device 2 and the exposure unit 16 together form a latent image forming unit. The electrostatic latent image formed on the photoconductor 1 is transported to a development area A (shown in FIG. 2) facing a development device 3 as the photoconductor 1 rotates.

The development device 3 includes a casing 301 (shown in FIG. 2), serving as a developer container for containing two-component developer consisting essentially of toner and carrier and transports the developer to the development area A, in which toner in the developer adheres to the electrostatic latent image formed on the photoconductor 1. Thus, the electrostatic latent image is developed into a toner image.

The toner image is then transported to a portion facing the transport belt 15, that is, a transfer area B shown in FIG. 2, as the photoconductor 1 further rotates. The image forming unit 17 further includes a transfer device 5 positioned across the transport belt 15 from the photoconductor 1, on an inner side of the transport belt 15. The transfer device 5 in the present embodiment employs a transfer roller to which a transfer bias is applied. Alternatively, a corona discharge-type transfer device may be used. The image forming unit 17 further includes a cleaning unit 6 positioned downstream from the transfer device 5 in the rotational direction of the photoconductor 1. The cleaning unit 6 includes a cleaning blade 601, shown in FIG. 2, for removing any toner remaining on the circumferential surface of the photoconductor 1 after the toner image is transferred therefrom onto the transfer sheet 8.

Multicolor image formation in the printer 100 is described below.

In multicolor image formation, in each image forming unit 17, the circumferential surface of the photoconductor 1 is uniformly charged by the charging device 2 in the dark. Then, the exposure unit 16 directs the writing light L onto the charged circumferential surface of the photoconductor 1, thus forming an electrostatic latent image thereon. Subsequently, the development device 3 develops the electrostatic latent image with toner, and thus single-color toner images are formed on the respective photoconductors 1.

Meanwhile, the transfer sheet 8 on the top, for example, in the sheet cassette 20 is picked up and fed along a sheet conveyance path 26 to a pair of registration rollers 23. The registration rollers 23 stop the transfer sheet 8 and then send out the transfer sheet 8, timed to coincide with image formation in the image forming unit 17K. Then, the transfer sheet 8 is attracted to the transport belt 15 electrostatically and is transported to the image forming unit 17K positioned extreme upstream in the sheet conveyance direction.

In the image forming unit 17K, the transfer device 5 transfers the black toner image from the photoconductor 1K onto the transfer sheet 8. Then, the respective toner images on the photoconductors 1M, 1Y, and 1C are transferred and superimposed one on another on the black image formed on the transfer sheet 8 carried by the transport belt 15.

Thus, a multicolor toner image is formed on the transfer sheet 8, after which the transfer sheet 8 is separated from the transport belt 15 and is forwarded to a fixing device 24. While the transfer sheet 8 passes between a pair of fixing rollers provided in the fixing device 24, the multicolor toner image is fixed thereon. Then, the transfer sheet 8 is discharged onto the discharge tray 25.

Meanwhile, the cleaning unit 6 removes any toner remaining on the circumferential surface of the photoconductor 1 after image transfer in preparation for subsequent image formation. The circumferential surface of the photoconductor 1 that has passed through the cleaning unit 6 is again charged by the charging device 2 uniformly. Thus, image formation is repeated.

It is to be noted that features of the present embodiment can adapt to an intermediate transfer method in which toner images formed on the photoconductors 1 are primarily transferred and superimposed one on another on an intermediate transfer member, such as an intermediate transfer belt, and then transferred from the intermediate transfer member onto the transfer sheet. In such a configuration, the toner image formed on the photoconductor 1 is transferred in the transfer area B onto the intermediate transfer member.

Next, the development device 3 is described in further detail below.

FIG. 2 is a schematic end-on axial view of the image forming unit 17 in the printer 100 according to the present embodiment. It is to be noted that, in FIG. 2, reference numeral 320 represents two-component developer.

Referring to FIG. 2, the development device 3 according to the present embodiment includes a development roller 302 serving as a developer carrier, and an interior of the casing 301 is divided by a partition 306 into a supply compartment 301S and a collection compartment 301C. The supply compartment 301S extends in an axial direction of the development roller 302, which is a direction perpendicular to the surface of paper on which FIG. 2 is drawn. While being transported in that direction, the two-component developer 320 including toner and carrier in the supply compartment 301S is supplied onto a surface of the development roller 302 that is rotating.

The development roller 302 transports the developer 320 carried thereon to the development area A, in which toner in the developer 320 adheres to the electrostatic latent image formed on the photoconductor 1, thus developing it into a toner image. An opening is formed in the casing 301 of the development device 3 to expose the development roller 302 partially. The exposed portion of the development roller 302 faces the photoconductor 1 and is positioned close to and to a side of the photoconductor 1 (in the lateral direction in FIG. 2). Thus, the development area A is formed in the portion where the development roller 302 faces the photoconductor 1.

As shown in FIG. 2, the developer 320 that has passed through the development area A is collected from the development roller 302 in the collection compartment 301C separate from the supply compartment 301S. Thus, the development device 3 employs a supply-collection separation method.

The development device 3 includes a first conveyance screw or supply screw 304 provided in the supply compartment 301S for transporting developer therein and a second conveyance screw or collection screw 305 provided in the collection compartment 301C for transporting developer therein. The development device 3 further includes a doctor blade 303 for adjusting the amount of developer carried on the development roller 302.

It is to be noted that, in FIG. 2, reference numeral 9 represents a release area in which developer is separated from the development roller 302, and 10 represents an attraction area in which developer in the supply compartment 301S is carried onto the development roller 302. Additionally, reference character O-302 represents center of rotation of the development roller 302, O-2 represents that of the photoconductor 1, O-304 represents that of the first conveyance screw 304, and O-305 represents that of the second conveyance screw 305.

Figure 3:
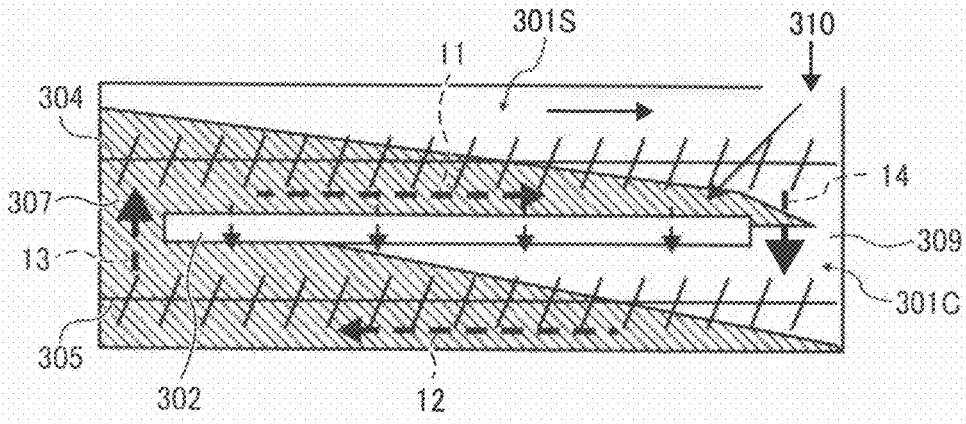
FIG. 3 is a schematic cross-sectional view from a side of a development device according to an illustrative embodiment and illustrates flow of developer in the development device.

FIG. 3 is a schematic cross-sectional view from a side of the development device 3 according to the present embodiment and illustrates flow of developer therein.

In the development device 3, the collection compartment 301C is positioned beneath the supply compartment 301S, and thus employs a vertical agitation arrangement. The developer transported in the direction indicated by arrow 11 shown in FIG. 3 (hereinafter "developer conveyance direction") by the first conveyance screw 304 to a downstream end portion therein is transported through a communication port 309 (first communication port) formed on a bottom of that portion of the supply compartment 301S, as indicated by arrow 14, to an upstream end portion of the collection compartment 301C in the developer conveyance direction. Then, the developer transported in the direction indicated by arrow 12 by the second conveyance screw 305 to a downstream end portion of the collection compartment 301C is further transported through an opening 307 (second communication port) formed therein, as indicated by arrow 13 shown in FIG. 3, to an upstream end portion of the supply compartment 301S.

It is to be noted that, in FIG. 3, reference numeral 310 represents a toner supply port, and 308 represents a bladed wheel formed in the downstream end portion, corresponding to the opening 307, of the collection compartment 305 in the developer conveyance direction by the second conveyance screw 305. The bladed wheel 308 is described in further detail later with reference to FIG. 8.

Next, the development roller 302 is described below with reference to FIGS. 5 and 6.

Figure 5:
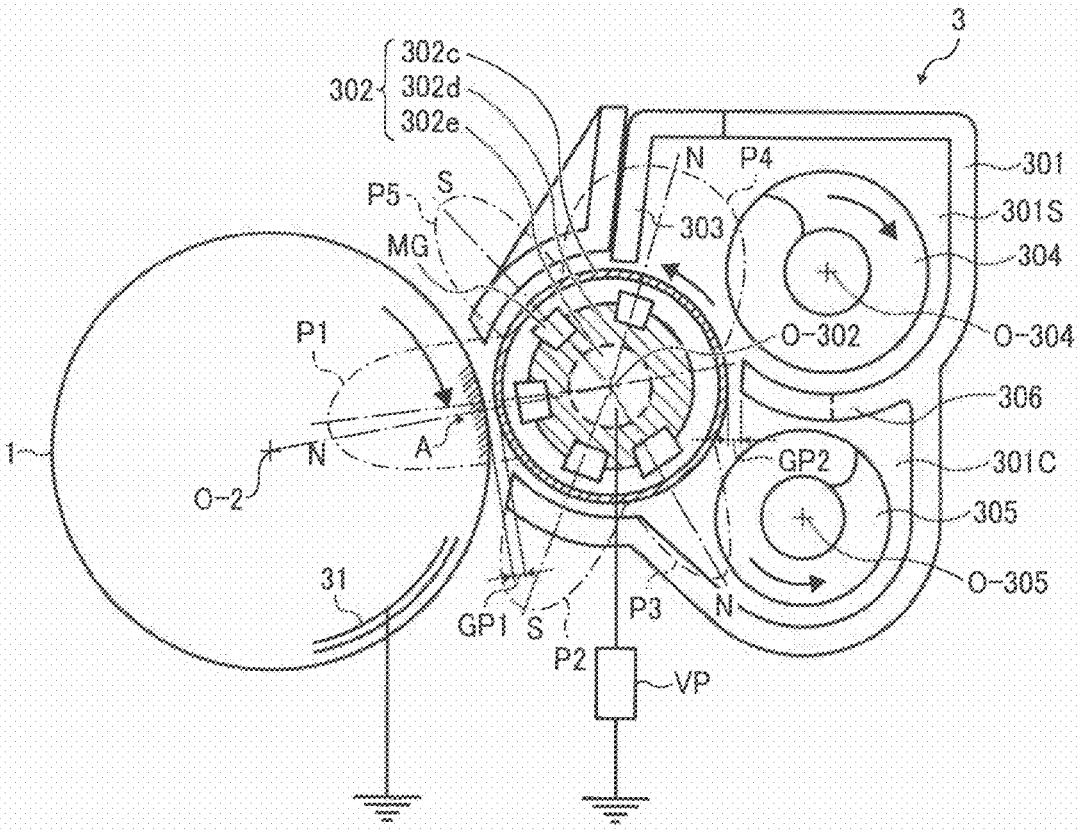
FIG. 5 illustrates distribution of magnetic flux density superimposed on a schematic end-on axial view of the development device.

FIG. 5 illustrates distribution of magnetic flux density superimposed on a schematic end-on axial view of the development device 3.

Referring to FIG. 5, a magnet roller 302*d* is provided inside the development roller 302, and its position is fixed relative to the development device 3. The magnet roller 302*d* includes multiple magnets MG arranged in a circumferential direction of thereof, and a cylindrical sleeve 302*c* provided outside the magnet roller 302*d* rotates integrally with a rotary shaft 302*e*. It is to be noted that, in FIG. 5, only one of the multiple magnets provided in the magnet roller 302*d* is given the reference character "MG" for simplicity. The sleeve 302*c* is formed of nonmagnetic metal such as aluminum although other materials may be included therein. The magnet roller 302*d* is fixed to the casing 301, for example, so that each magnet MG faces in a predetermined direction. The development roller 302 transports the developer 320 carried on a surface of the sleeve 302*c*, attracted by magnetic force exerted by the magnet MG, in the circumferential direction thereof as the sleeve 302*c* rotates.

It is to be noted that, in FIG. 5, reference characters GP1 designates a gap between the photoconductor 1 and the development roller 302 (i.e., development gap), and GP2 designates a gap between the development roller 302 and the partition 306.

Figure 6:
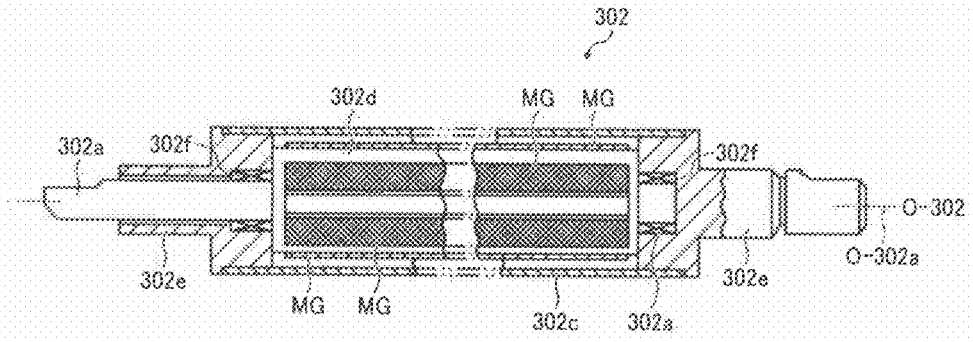
FIG. 6 is a cross-sectional view from a side of a development roller included in the development device.

FIG. 6 is a cross-sectional view of the development roller 302 along the axial direction thereof. In FIG. 6, reference character O-302*a* designates a center line passing through the center of rotation O-302 of the development roller 302.

The development roller 302 further includes a fixed shaft 302*a* fixed to the casing 301, the magnet roller 302*d*, which is cylindrical and united to the fixed shaft 302*a*, the sleeve 302*c* overlaying the magnet roller 302*d* across a gap, and the rotary shaft 302*e* united to the sleeve 302*c*. The rotary shaft 302*e* is rotatable relative to the fixed shaft 302*a* via bearings 302*f*, and the rotary shaft 302*e* is driven by a driving unit, not shown.

As shown in FIG. 6, the multiple magnets MG are fixed on an outer circumferential surface of the magnet roller 302*d*, arranged at predetermined intervals. The sleeve 302*c* rotates around the magnets MG. The magnets MG form magnetic fields to cause developer particles to stand on end on the circumferential surface of the sleeve 302*c* and to separate the developer particles from the sleeve 302*c*. In the present embodiment, five magnets MG are provided inside the sleeve 302*c*, thus generating five magnetic poles, as shown in the distribution of magnetic flux shown in FIG. 5. It is to be noted that hereinafter the magnetic pole positioned on a vertical line connecting the center of rotation O-302 of the development roller 302 and the center of rotation O-2 of the photoconductor 1 is referred to as a magnetic pole P1, and other magnetic poles are respectively referred to as magnetic poles P2, P3, P4, and P5 from the upstream side in the rotational direction of the development roller 302.

The polarity of the magnetic poles P1, P2, P3, P4, and P5 are north (N), south (S), N, N, and S, respectively. Alternatively, the magnetic poles P1 through P5 may have the reverse polarities to those shown in FIG. 5. On the development roller 302 shown in FIG. 5, centers of the magnetic poles P1, P2, P3, and P4 are substantially at eight o'clock, seven o'clock, five o'clock, and one o'clock, respectively.

In the development area A, the development roller 302 is not in direct contact with the photoconductor 1, and the development gap GP1 having a predetermined distance suitable for image development is kept between the development roller 302 and the photoconductor 1. Developer particles are caused to stand on end on the circumferential surface of the development roller 302 in the magnetic pole P1 and brought into contact with the surface of the photoconductor 1. Thus, toner particles can adhere to the electrostatic latent image formed thereon, developing the latent image.

Referring to FIG. 5, a grounded power source VP for generating development bias is connected to the fixed shaft 302*a*. Voltage from the power source VP connected to the fixed shaft 302*a* is applied via the electroconductive bearings 302*f* and the electroconductive rotary shaft 302*e* to the sleeve 302*c*. By contrast, as shown in FIG. 5, an electroconductive support body 31 that forms an innermost layer of the photoconductor 1 is grounded. Thus, an electrical field for conveying toner particles separated from carrier particles toward the photoconductor 1 is formed in the development area A, and accordingly the toner particles move toward the photoconductor 1 due to differences in electrical potential between the sleeve 302*c* and the electrostatic latent image formed on the surface of the photoconductor 1.

It is to be noted that the present embodiment describes development devices to be used in image forming apparatuses that involve an exposure process using optical writing light L. More specifically, the charging device 2 shown in FIG. 2 charges the photoconductor 1 uniformly to a negative electrical potential, and the portion on which an image is to be formed (i.e., an image portion) is exposed to the writing light L so as to reduce the amount of optical writing. Then, the image portion, that is, an electrostatic latent image, that has a reduced electrical potential is developed with toner particles whose polarity is negative, which is a method so-called "reversal development". This is just an example, and, in development methods to which the features of the present invention are applicable are not limited to the description above regarding the polarity of charging potential of the photoconductor 1.

After being used in image development in the development area, the developer 320 is kept on the development roller 302 by the magnetic force exerted by the magnetic pole P2 and is conveyed inside the casing 301 as the development roller 302 rotates. The portion of the casing 301 corresponding to the magnetic pole P2 is positioned close to the circumferential surface of the sleeve 302*c* and curved conforming to the circumferential surface of the sleeve 302*c*. Therefore, scattering of toner particles is alleviated with sealing effects.

The magnetic poles P3 and P4 positioned downstream from the magnetic pole P2 in the rotational direction of the development roller 302 have an identical polarity. Consequently, magnetic force attracting the developer 320 to the surface of the development roller 302 becomes weaker between the magnetic poles P3 and P4, and effects of releasing the developer 320 from the development roller 302 act in the release area 9 shown in FIGS. 2 and 4. After image development, because toner therein has moved to the photoconductor 1 and adhered to the latent image, the developer 320 has a reduced toner concentration. Therefore, desired image density might not be attained if such developer 320 having a reduced toner concentration is not separated from the development roller 302 but is carried again to the development area A (hereinafter "carryover of developer") and used in image development.

In view of the foregoing, in the present embodiment, the developer 320 is separated from the development roller 302 in the release area 9 (shown in FIG. 4) and collected in the collection compartment 301C (shown in FIG. 5) separate from the supply compartment 301S to prevent carryover of developer.

Subsequently, the surface of the development roller 302 from which the developer 320 is separated reaches a portion facing the supply compartment 301S as the development roller 302 rotates. The magnetic pole P4 is present at that position, and the developer 320 flowing in the supply compartment 301S is attracted to the attraction area 10 of the development roller 302 and carried thereon by the magnetic force exerted by the magnetic pole P4. Then, while passing by the development doctor 303, the amount of the developer 320 carried by the magnetic force exerted by the magnetic pole P4 on the development roller 302 is adjusted, after which the developer 320 is transported to the development area A. The magnetic pole P5 positioned between the magnetic poles P4 and P1 serves as a developer conveyance pole for keeping developer on the surface of the development roller 302 in an area extending from the development doctor 303 to the development area A.

Next, arrangement of respective components in the development device 4 is described below also with reference to FIGS. 7 and 8 as required.

Figure 7:
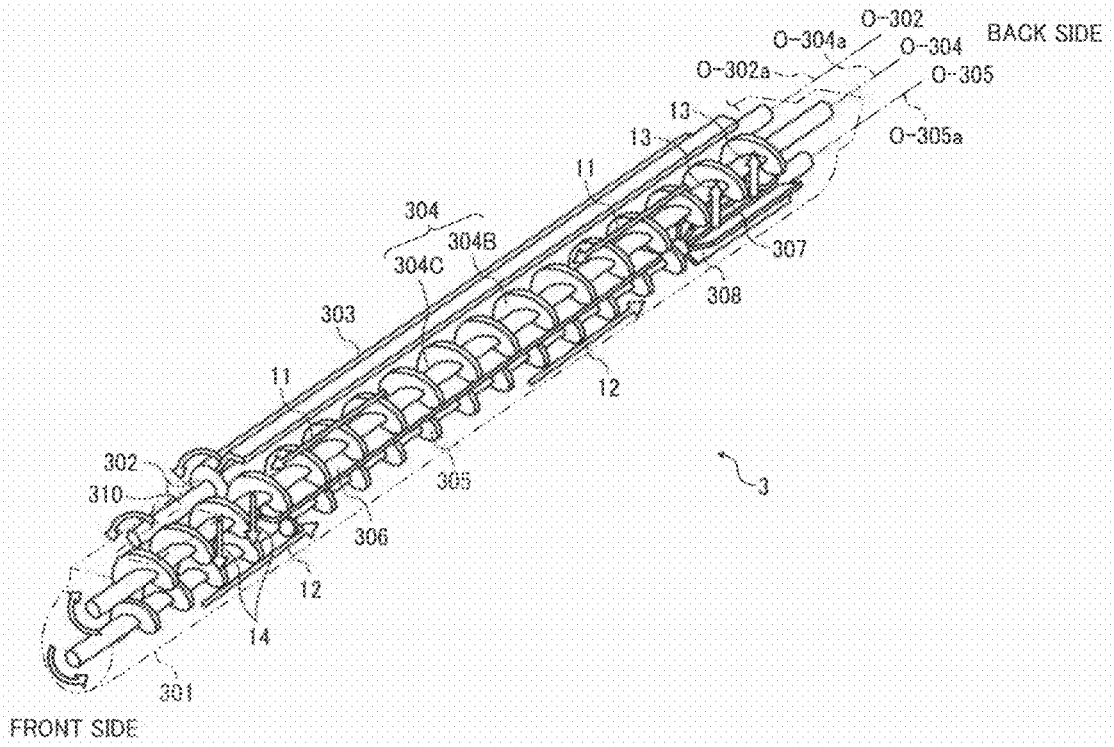
FIG. 7 is a perspective view illustrating a configuration of a developer circulation mechanism in the development device.
Figure 8:
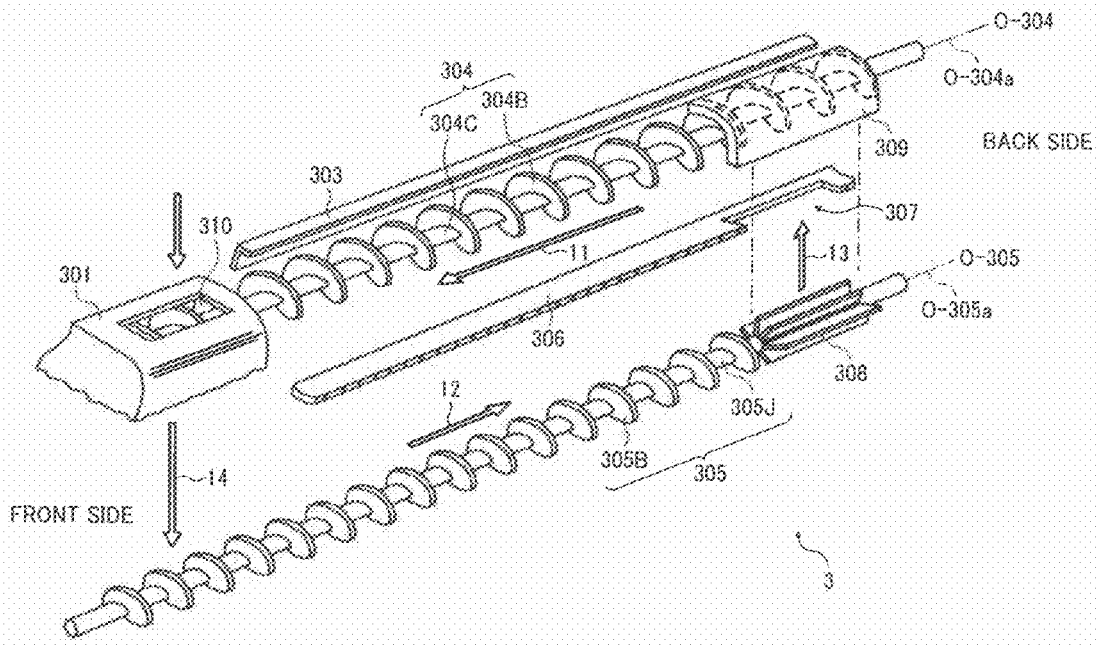
FIG. 8 is an exploded view of the developer circulation mechanism.

FIG. 7 is a perspective view illustrating the components of the development device 4 assembled, and FIG. 8 is an exploded view of the components of the development device 4. It is to be noted that, in FIGS. 7 and 8, reference character O-304*a* represents a centerline that passes through the center of rotation O-304 and parallels the centerline O-302*a* of the development roller 302.

As shown in FIGS. 7 and 8, the first conveyance screw 304 provided in the supply compartment 301S includes a spiral blade 304B fixed to a screw shaft 304C and rotates clockwise in FIG. 7 on the centerline O-304*a* as indicated by an arrow shown in FIG. 7. With this configuration, the first conveyance screw 304 transports developer from the back side to the front side in FIG. 7 as indicated by arrow 11 while agitating the developer. In other words, the first conveyance screw 304 transports developer in the axial direction from the back side to the front side in FIG. 7.

Similarly, as shown in FIGS. 7 and 8, the second conveyance screw 305 provided in the collection compartment 301C includes a spiral blade 305B fixed to a screw shaft 305J and rotates counterclockwise in FIG. 7 as indicated by an arrow shown in FIG. 7 on a centerline O-305*a* that passes through its center of rotation O-305 and parallels the centerline O-302*a* of the development roller 302. With this configuration, the second conveyance screw 305 transports developer from the front side to the back side in FIG. 7 as indicated by arrow 12 while agitating the developer. In other words, the second conveyance screw 305 transports developer in the axial direction from the front side to the back side in FIG. 7, which is opposite the developer conveyance direction of the first conveyance screw 304.

The partition 306 provided between the first conveyance screw 304 and the second conveyance screw 305, thus separating the supply compartment 301S including the first conveyance screw 304 from the collection compartment 301C including the second conveyance screw 305, is shaped like a cantilever supporter with one side thereof united to an inner face of the casing 301 on the side opposite the development roller 302. The partition 306 is provided only in a center portion and is not present in both end portions in the long axis direction of the development roller 302. By contrast, the first and second conveyance screws 304 and 305 extend into both end portions in the long axis direction of the development roller 302.

In the collection compartment 301C, developer is transported in the direction indicated by arrow 12 and then is blocked by a side wall of the casing 301 in the downstream end portion in the developer conveyance direction therein. Thus, the developer is piled against the side wall of the casing 301 and then moves in the direction indicated by arrow 13 through the opening 307 to the supply compartment 301S. In the supply compartment 301S, developer is transported in the direction indicated by arrow 11 and then flows down in the direction indicated by arrow 14 through the communication port 309 to the collection compartment 301C.

Thus, the developer can move between the supply compartment 301S and the collection compartment 301C in the both end portions in the long axis direction where the partition 306 is not present, and accordingly a developer circulation path in which developer flows in the order of arrows 11, 14, 12, and 13 is formed. Additionally, the partition 306 supports the developer 320 agitated by the first conveyance screw 304 from below, thus forming the supply compartment 301S. Simultaneously, the partition 306 inhibits the developer separated from the development roller 302 in the release area 9 and collected in the collection compartment 301C from moving to the supply compartment 301S.

To secure these functions, the gap GP2 between the circumferential surface of the development roller 302 and the partition 306 is preferably within a range of about 0.2 mm to 1 mm. If the gap GP2 is less than 0.2 mm, the development roller 302 might contact the partition 306 due to eccentricities in rotation of the development roller 302. If the gap GP2 is greater than 1 mm, the effect of inhibiting the collected developer from moving to the supply compartment 301S might be insufficient.

Further, although the partition 306 functions even if positioned shifted from the release area 9, the partition 306 might regulate a relatively large amount of developer in such an arrangement, thus increasing stress to the developer. Therefore, such an arrangement is not preferred unless arrangement described below is considered. Therefore, in the present embodiment, the release area 9 is disposed around the development roller 302 on the side opposite the photoconductor 1 and lower than the attraction area 10, and the attraction area 10 is disposed adjacent to and downstream from the release area 9 in the rotational direction of the development roller 302. Additionally, the partition 306 is disposed in a portion between the release area 9 and the attraction area 10, where the amount of developer adhering to the surface of the development roller 302 is extremely small so as to separate the space around the first conveyance screw 304 from the space around the second conveyance screw 305. Moreover, an edge face of the partition 306 on the side of the development roller 302 faces the development roller 302.

With this configuration, even if the gap GP2 is out of the range from 0.2 mm to 1 mm, the partition 306 can function because the partition 306 is provided in the portion where the amount of developer adhering to the surface of the development roller 302 is small. Additionally, stress to the developer caused by the partition 306 can be reduced. That is, the limitation in the size of the gap GP2 between the development roller 302 and the partition 306 can be alleviated in designing the device. It is to be noted that stress to the developer can be further reduced by satisfying the range from about 0.2 mm to 1 mm as the size of the gap GP2, in addition to the above-described arrangement.

In addition, in the present embodiment, the partition 306 is positioned so that the partition 306 is closest to the development roller 302 in a portion between the first conveyance screw 304 and the second conveyance screw 305 where the amount of developer adhering to the surface of the development roller 302 is extremely small, that is, within the release area 9 between the magnetic pole P3 and the magnetic pole P4, where the density of magnetic flux on the surface of the development roller 302 is less than 10 mT.

Additionally, in the present embodiment, as shown in FIG. 8, the bladed wheel 308 is provided instead of the spiral blade 305B in the downstream end portion, in the area corresponding to the opening 307, of the collection compartment 301C in the developer conveyance direction of the second conveyance screw 305. The bladed wheel 308 includes multiple planar blades radially extending from the screw shaft 305J (centerline O-305*a*) of the second conveyance screw 305 and flips up developer as the second conveyance screw 305 rotates.

Figure 4:
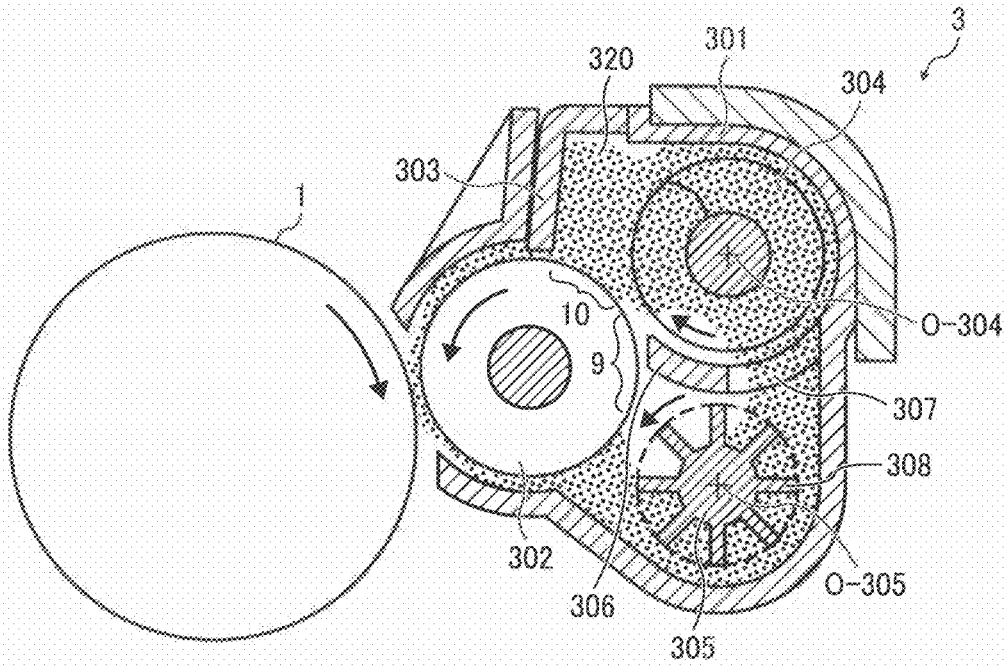
FIG. 4 is an end-on axial view illustrating a downstream end portion of a collection compartment in the development device.

As shown in FIG. 4, the centers of rotation O-304 and O-305 of the first and second conveyance screws 304 and 305 are substantially on an identical vertical line, and the bladed wheel 308 rotates counterclockwise in FIG. 4 while flipping up developer against the inner face of the casing 301. The opening 307 extends from the position slightly shifted toward the inner face of the casing 301 from the vertical line connecting the centers of axes O-304 and O-305 to the inner face of the casing 301 so that the route in which the flipped developer moves is not blocked, and simultaneously the flipped developer does not fall toward the second conveyance screw 305. In other words, although the opening 307 connecting the supply compartment 301S and the collection compartment 301C is formed in the partition 306 in the portion where developer is brought up from the second conveyance screw 305 to the first conveyance screw 304, the partition 306 is present on the side closer to the development roller 302 in the portion corresponding to the opening 307 similarly to the center portion in the longitudinal direction of the development roller 302. With that portion of the partition 306, the developer brought up through the opening 307 does not fall down to the second conveyance screw 305 but is attracted to the development roller 302. Then, the developer is either transported by the development roller 302 to the second conveyance screw 305 or to the first conveyance screw 304. Thus, the developer can be circulated efficiently.

The first conveyance screw 304 rotates clockwise FIG. 4, opposite the direction in which the development roller 302 rotates. Generally, while transporting objects in their rotational directions, screws draw the object to be transported to the rotational direction. Therefore, the first conveyance screw 304 transports developer while drawing the developer to the side of the development roller 302. Consequently, the amount of developer in contact with the development roller 302 can be increased, and developer can be supplied to the development roller 302 reliably.

By contrast, the second conveyance screw 305 rotates counterclockwise in FIG. 4, which is identical to the direction in which the development roller 302 rotates. With this configuration, the second conveyance screw 305 transports developer while drawing the developer to the opposite side of the development roller 302. Therefore, the developer once separated from the development roller 302 in the release area 9 by the magnetic force or the partition 306 can be prevented from adhering to the development roller 302 again. Thus, the developer having a reduced toner concentration after image development can be prevented from moving to the supply compartment 301S in which the first conveyance screw 304 is provided.

Next, supply of toner to the development device 3 is described below.

Because toner in the developer 302 contained in the development device 3 is consumed in image development, toner must be externally supplied to the developer in the development device 3. It is preferred that the toner supply position be positioned further from the upstream end portion of the supply compartment 301S on the developer circulation path, outside the portion facing the development area A of the development roller 302, to prevent insufficiently charged toner from being supplied to the development area A.

Herein, in the vertical agitation arrangement, the communication port 309 is provided to transport the developer from the downstream end portion of the supply compartment 301S to the upstream end portion of the collection compartment 301C. Because the communication port 309 is preferably positioned outside the development area A so as not to cause shortage of developer supplied to the development area. Thus, the supply compartment 301S is made longer than the development roller 302 in the axial direction of the developer carrier 302 so that its downstream end portion is positioned outside the development area A. In such a configuration, it is not necessary to expand the supply compartment 301S further in the axial direction of the developer carrier 302 when toner is supplied to the extended portion.

Therefore, in the present embodiment, as shown in FIG. 8, the toner supply port 310 is provided above the downstream end portion of the supply compartment 301S (on the front side of the development device 3) where the communication port 309 is formed, outside the development area A. More specifically, the toner supply port 310 is formed in the casing 301 above the front-side end portion where the partition 306 is not present.

Referring to FIGS. 5 and 8, toner supplied through the toner supply port 310 falls from the downstream end portion of the supply compartment 301S, outside the area facing the development roller 302 (i.e., the development area A), through the communication port 309 to the upstream end portion of the collection compartment 301C together with the developer. The toner is then transported in the collection compartment 301C by the second conveyance screw 305 while being mixed with the developer.

In the present embodiment, because supply and collection of the developer are performed in different developer conveyance compartments as described above, the developer flowing through the collection compartment 301C is not supplied to the development roller 302. Therefore, insufficiently charged developer in which the concentration of toner is uneven due to the toner newly supplied through the toner supply port 310 is not supplied to the development roller 302 nor is used in image development as is. In the collection compartment 301C, the supplied toner is mixed with the developer collected from the development roller 302, having a reduced toner concentration. Before reaching the downstream end portion of the collection compartment 301C, the developer thus mixed can be charged sufficiently and the toner concentration can be equalized. Subsequently, the developer is brought up through the opening 307 to the supply compartment 301S by the bladed wheel 308 or the like. While being transported to the front side of the device by the first conveyance screw 304, the developer is supplied to the development roller 302 and used in image development.

It is to be noted that, although the description above concerns the configuration in which developer is circulated in two developer conveyance compartments, namely, the supply compartment 301S and the collection compartment 301C positioned beneath the supply compartment 301C, the above-described features can adapt to configurations in which developer is circulated in three or greater developer conveyance compartments as long as one of them is positioned beneath the supply compartment and developer transported to the downstream end portion of the supply compartment falls to that developer conveyance compartment through the communication port.

Description will be given below of inhibiting developer from being supplied to the development area immediately after receiving supplied toner, thereby preventing or reducing scattering of toner in the backgrounds of output images.

Referring to FIG. 3, in the present embodiment, the downstream end portion of the supply compartment 301S where the communication port 309 is provided, outside the area facing the development roller 302 (i.e., development area A), is relatively short in the axial direction of the development roller 302 to make the supply compartment 301S shorter in the longitudinal direction, thereby making the device relatively compact. Toner supply is performed in such a downstream end portion of the supply compartment 301S, that is, in an area adjacent to the development area A of the development roller 302.

Additionally, toner is supplied downward to the downstream end portion of the supply compartment 301S. Therefore, before being mixed in developer, the supplied toner particles can partly float in the air because they are fine particles having a small particle diameter. Moreover, in the present embodiment that employs the supply-collection separation method, the amount of developer is smaller in the downstream end portion of the supply compartment 301S than in the upstream end portion of the supply compartment 301S. Therefore, space above the developer is larger on the downstream side than the upstream side in the supply compartment 301S. Therefore, a greater amount of toner particles can float in the downstream end portion of the supply compartment 301S compared with a case in which toner is supplied in the upstream end portion thereof. Because the downstream end portion of the supply compartment 301S is adjacent to the area facing the development area A of the development roller 302 as described above, the floating toner particles just after supplied to the supply compartment 301S are likely to move to the area facing the development area A and further be carried by the development roller 302 to the development area A. If such toner particles just after supplied are transported to the development area A, it is possible that the toner particles scatter in the background of output images or around the interior of the image forming apparatus.

It is to be noted that the phenomenon described above can occur also in supply-collection separation-type development devices in which another developer conveyance compartment separate from the collection compartment 301C is provided beneath the supply compartment 301S and developer is transported from the downstream end portion of the supply compartment 301S through a communication port to the developer conveyance compartment.

It is to be noted that providing the toner supply port 310 in the downstream end portion of the supply compartment 301S as in the present embodiment has an advantage that supplied toner can be mixed in developer promptly, compared with a comparative development device in which the toner supply port is provided in the collection compartment.

More specifically, if the toner supply port is provided in the collection compartment, developer is transported in the collection compartment together with the supplied toner accumulated on the surface of the developer, and most of the supplied toner can remain on the surface of the developer until transported to the downstream end of the collection compartment. In an experiment using the comparative development device, it was visually confirmed that about one third of supplied toner was not mixed in the developer but remained on the surface of the developer until transported to the downstream end of the collection compartment. It is to be noted that the supplied toner accumulating on the surface of the developer is mixed with developer in the downstream end of the collection compartment where developer is piled up and then is brought up through the opening to the supply compartment.

By contrast, in the present embodiment in which the toner supply port 310 is provided in the downstream end portion of the supply compartment 301S, developer flowing in the supply compartment 301S is supplied to the toner supplied through the toner supply port 310 down on the surface of the developer. Subsequently, the supplied toner is further mixed with developer while falling through the communication port 309. The mixed developer is then transported through the collection compartment 301C by the second conveyance screw 305 to the downstream end portion of the collection compartment 301C while agitated also with the developer collected from the development roller 302, having a reduced toner concentration. In the downstream end portion of the collection compartment 301C, the developer is further agitated in the portion where developer is piled up through the opening 307, thus brought up to the supply compartment 301S. In an experiment using the development device 3 according to the present embodiment, it was visually confirmed that about half the supplied toner was mixed in the developer while being transported to the upstream end portion of the collection compartment 301C. Before being transported to the downstream end of the collection compartment 301C, almost all the supplied toner was mixed in the developer.

Although the supplied toner can be substantially mixed with developer promptly in the present embodiment, still, there can be toner particles not mixed in the developer but float in the air.

In particular, if the spiral blade 304B of the first conveyance screw 304 is present in the portion where the supplied toner falls down, and is partly exposed above the surface of developer, the spiral blade 304B agitates air in the space where the supplied toner falls when the first conveyance screw 304 rotates. Thus, the blade spiral 304B stirs up the supplied toner that is not mixed in the developer. Additionally, if the portion of developer where the supplied toner falls down is agitated, it can happen that the supplied toner is stirred up again from the developer after being mixed therein.

In view of the foregoing, the present embodiment inhibits the floating supplied toner in the downstream end portion of the supply compartment 301S from being supplied to the development area A as follows.

Figure 9:
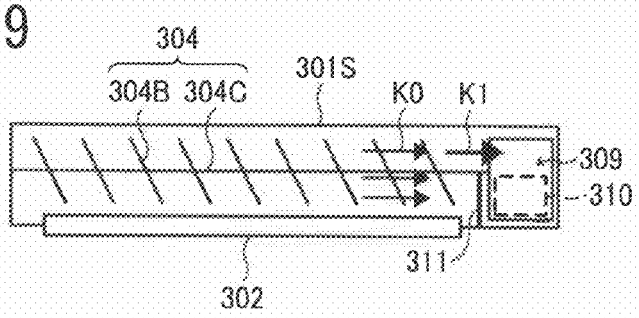
FIG. 9 is a schematic top view illustrating an interior of a supply compartment in the development device.

FIG. 9 is a schematic top view illustrating the interior of the supply compartment 301S.

In the supply compartment 301S, developer is partly carried onto the surface of the development roller 302 while being transported downstream (in FIG. 9, to the right). Therefore, the amount of developer is greater on the upstream side and decreases downstream (to the right in FIG. 9) in the supply compartment 301S.

Referring to FIG. 9, in the supply compartment 301S, the developer flows downstream and, in the downstream end portion, falls down through the communication port 309 to the collection compartment 301C. Accordingly, an airflow K0 flowing in the same direction as the direction in which the developer flows is present above the developer in the downstream end portion of the supply compartment 301S.

In the present embodiment, a rib 311, serving as an airflow path limiter, is provided in the downstream end portion of the supply compartment 301S so as to restricts an airflow path in which the airflow K0 flows above the developer in the supply compartment 301S, in particular, to reduce a cross-sectional area of the airflow path. The rib 311 is positioned closer to the development area of the development roller 302 than the toner supply port 310, that is, upstream from the toner supply port 310 in the developer conveyance direction or axial direction of the development roller 302.

Figure 10:
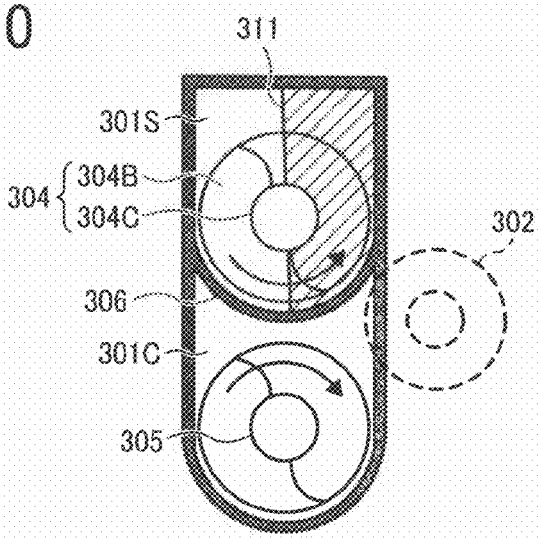
FIG. 10 is a schematic end-on axial view of a portion of the supply compartment where a rib is provided.

As shown in FIG. 10, in the present embodiment, the rib 311 blocks partly or narrows the path through which the floating toner particles, supplied through the toner supply port 310, move toward the development roller 301. Typically, the velocity of airflow increases in the narrowed portion because the amount of air flowing does not change in front and the back of the narrowed portion. Consequently, an airflow K1 that hinders movement of the floating toner particles to the side of the development roller 302 becomes stronger than the airflow K0 flowing in a portion where the rib 311 is not provided. Therefore, the amount of floating toner particles that move to the side of the development roller 302 can be effectively reduced compared with a case in which the rib 311 is not provided.

For example, as the size of the rib 311, the rib 311 may extend about half the width of the supply compartment 301S, that is, the length of the supply compartment 301S in the direction horizontal and perpendicular to the axial direction of the development roller 302. It is to be noted that, in the supply compartment 301S, the rib 311 extends not only in the space above the developer but also into the area where the developer flows as shown in FIG. 10. Although the rib 311 hinders the flow of developer in the supply compartment 301S in this configuration to some extent, the developer can flow through the gap between the rib 311 and an inner face of the supply compartment 301S to the downstream end portion of the supply compartment 301S. Thus, circulation of developer is not inhibited. Rather, because the amount of developer is smaller on the downstream side in the supply compartment 301S, restricting the flow of developer with the rib 311 is advantageous in that the amount of developer on the downstream side can be increased, thus attaining reliable supply of toner to the development roller 302.

Additionally, because the amount of developer, hindered by the rib 311, increases on the downstream side in the supply compartment 301S, the surface level of the developer rises.

Consequently, the cross-sectional area of the airflow path through which the floating supplied toner particles move toward the development roller 302 can be further restricted. Therefore, the airflow K1 that inhibits the floating toner particles from moving toward the development roller 302 can become stronger, thus reducing the amount of the toner particles moving to the development roller 302 more effectively.

Additionally, as shown in FIG. 10, the rib 311 is positioned closer to the development roller 302 in the supply compartment 301S on a virtual plane perpendicular to the screw shaft 304C of the first conveyance screw 304, that is, in the direction horizontal and perpendicular to the axial direction of the development roller 302. This arrangement enables the rib 311 to block a linear route through which the supplied toner, fallen through the toner supply port 310, moves toward the development roller 302, thus attaining higher effects of inhibiting the supplied toner from moving toward the development roller 302 with the rib 311. Moreover, even if the floating toner overstrides the rib 311 against the airflow K1, the toner lands on the developer in a portion away from the development roller 302. Accordingly, before supplied onto the development roller 302, such toner particles are transported downstream in the supply compartment 301S and are not supplied to the development area A.

Additionally, as shown in FIG. 10, because the rib 311 extends from above the developer into the area of the developer in the supply compartment 301S, it is necessary to design the device so that the spiral blade 304B attached to the screw shaft 304C of the first conveyance screw 304 does not contact the rib 311. To prevent the contact between the first conveyance screw 304 and the rib 311, in the present embodiment, the spiral blade 304B is cut off in the portion corresponding to the rib 311. Alternatively, other arrangement may be used. For example, the spiral blade 304B of the first conveyance screw 304 may be reduced in size in the portion corresponding to the rib 311.

Moreover, if the spiral blade 304B of the first conveyance screw 304 is present in the downstream end portion of the supply compartment 301S, the spiral blade 304B flips up the developer as described above, which is not desirable. Therefore, it is more preferable that the spiral blade 304B of the first conveyance screw 304 be removed in the area extending from the position facing the rib 311 to the downstream end thereof in the developer conveyance direction. It is to be noted that removing that portion of the spiral blade 304B from the first conveyance screw 304 does not impose adverse effects in circulation of developer because developer moves down to the communication port 309 under its own weight.

Figure 11:
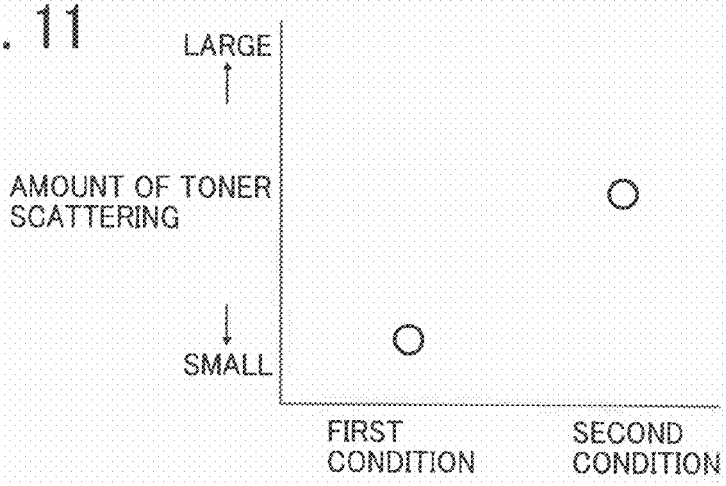
FIG. 11 is a graph illustrating results of an experiment to evaluate scattering of toner in backgrounds on a photoconductor when the rib is provided (first condition) and is not provided (second condition)

FIG. 11 is a graph illustrating results of an experiment to evaluate scattering of toner in backgrounds on the photoconductor 1 when the rib 311 is provided (first condition) and is not provided (second condition).

The term "scattering of toner in backgrounds" used herein means a phenomenon that toner adheres to the non-image area of the photoconductor 1 where an electrostatic latent image is not formed. Scattering of toner in backgrounds occurs frequently or the degree of toner scattering increases when the ratio of insufficiently charged toner is large, that is, frictional charging between toner and carrier is insufficient. In the experiment, toner particles adhering to the non-image area of the photoconductor 1 was collected with transparent adhesive tape, and density of the collected toner particles was measured with an X-Rite spectrophotometric color densitometer. As can be seen from FIG. 11, the degree of toner scattering in backgrounds was alleviated in the configuration in which the rib 311 was provided (first condition). The degree of toner scattering in backgrounds was thus alleviated because the rib 311 inhibited the supplied toner from being carried on the development roller 302, thereby preventing it from being used in image development.

As described above, the rib 311 can not only blocks the movement of floating toner to the development area by itself but also increase the strength of the airflow inhibiting the movement of floating toner to the development area. Therefore, the amount of floating toner moving to the development area can be reduced effectively.

Figure 12:
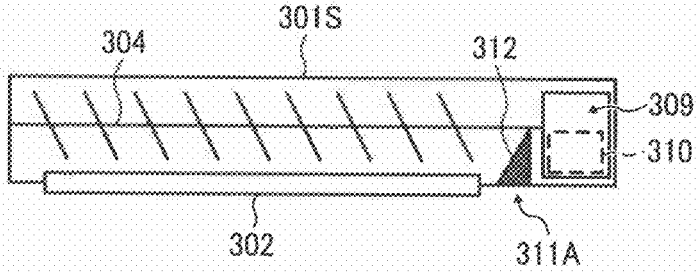
FIG. 12 is a schematic top view illustrating the interior of the supply compartment.

FIG. 12 illustrates a variation of the rib 311.

In FIG. 12, a face 312 of a rib 311A on the side receiving the developer flowing in the supply compartment 301S is inclined downstream in the developer conveyance direction therein. That is, a first end of the face 312 on the side of the gap between the rib 311A and the inner wall of the supply compartment 301S is positioned downstream from a second end opposite the first end of the rib 311A. The rib 311A may be triangular or trapeziform as shown in FIG. 12 when viewed from above. With this configuration, the airflow in the supply compartment 301S can be guided along the inclined surface 312 to the space between the rib 311 and the inner face of the supply compartment 301S, thus increasing the strength of the airflow K1 (shown in FIG. 9) flowing in that space. As a result, the effect of hindering the floating supplied toner particles from moving toward the development roller 302 can be increased.

The inclined surface 312 (shown in FIG. 12) of the rib 311A can also inhibit the developer in contact with the rib 311A from accumulating there in the configuration in which the rib 311A extends into the area where the developer flows in the supply compartment 301S as in the present embodiment.

(First Variation)

Next, descriptions are given below of a first variation of the above-described embodiment in which the configuration of the airflow path limiter is different.

Figure 13:
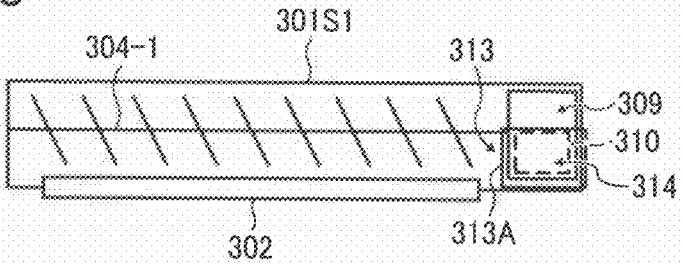
FIG. 13 is a schematic top view illustrating an interior of a supply compartment of a development device according to a first variation.
Figure 14:
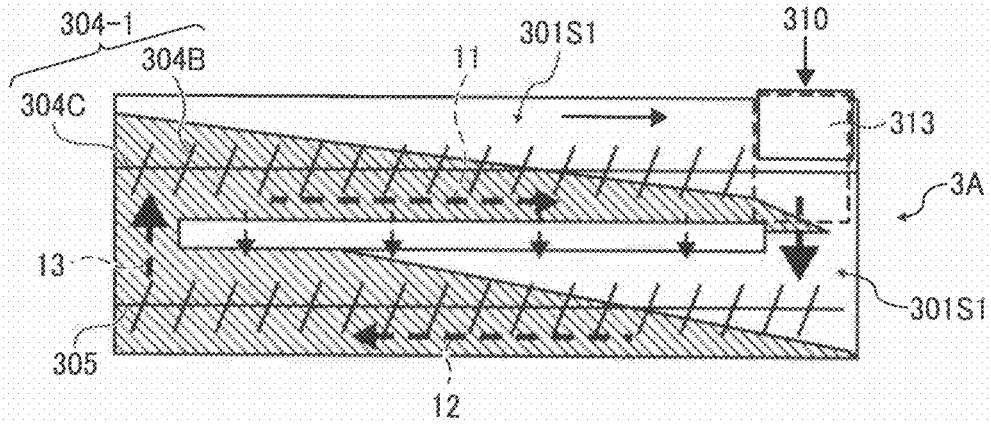
FIG. 14 is a schematic side view illustrating an interior of the development device according to the first variation.

FIG. 13 is a schematic top view illustrating an interior of a supply compartment 301S1 of a development device 3A according to the first variation. FIG. 14 is a schematic side view of the development device 3A according to the first variation.

In the first variation, a toner guide frame 313 forming a toner guide path 314 is provided in a supply compartment 301S1 for guiding the supplied toner fallen through the toner supply port 310 to a bottom portion of the supply compartment 301S1. In the first variation shown in FIGS. 13 and 14, a surface 313A, which receives the developer flowing in the supply compartment 301S1, of the toner guide frame 313 serves as the airflow path limiter instead of the above-described rib 311. Referring to FIG. 14, the lower end of the toner guide frame 313 is positioned slightly higher than the screw shaft 304C of a first conveyance screw 304-1 provided in the supply compartment 301S1. The spiral blade 304B of the first conveyance screw 304 does not present in the area corresponding to the toner guide frame 313.

In the first variation, the toner guide frame 313 can better restrict diffusion of the supplied toner in the supply compartment 301S1, compared with the above-described configuration in which the supplied toner falls directly to the supply compartment 301S through the toner supply port 310. Therefore, the floating supplied toner can be better inhibited from moving toward the development roller 302 and being used in image development.

It is to be noted that, as long as its lower end does not contact the screw shaft 304C of the first conveyance screw 304-1, the toner guide frame 313 may extend beneath the screw shaft 304C of the first conveyance screw 304-1 as indicated by broken lines shown in FIG. 14.

Figure 15:
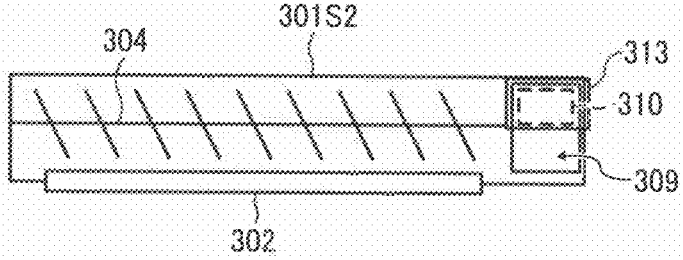
FIG. 15 is a schematic top view illustrating an interior of a supply compartment in which location of a toner guide frame is different from that in FIGS. 13 and 14.

Additionally, although the description above concern a configuration in which the toner guide frame 313 is disposed on the side closer to the development roller 302 in the supply compartment 301S1 on a virtual plane perpendicular to the screw shaft 304C of the first conveyance screw 304-1, alternatively, the toner guide frame 313 may be positioned on the side away from the development roller 302 as in a supply compartment 301S2 shown in FIG. 15.

(Second Variation)

Next, descriptions are given below of a second variation of the above-described embodiment in which the configuration of the developer circulation is different.

Figure 16:
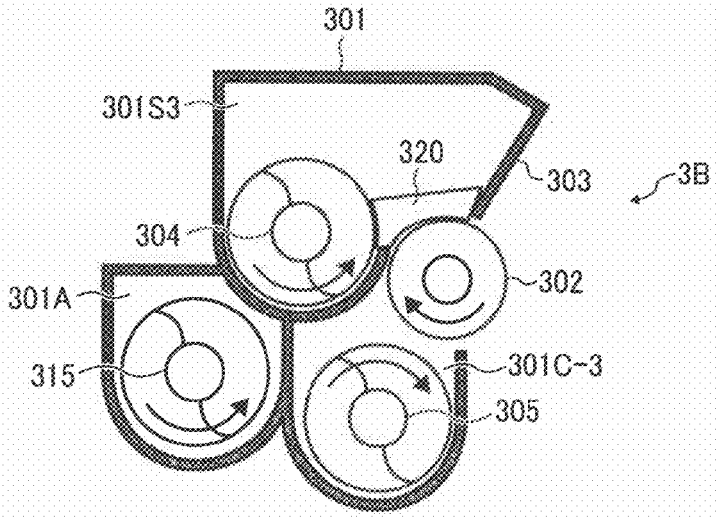
FIG. 16 is a schematic end-on axial view illustrating a configuration of a developer circulation mechanism according to a second variation.
Figure 17:
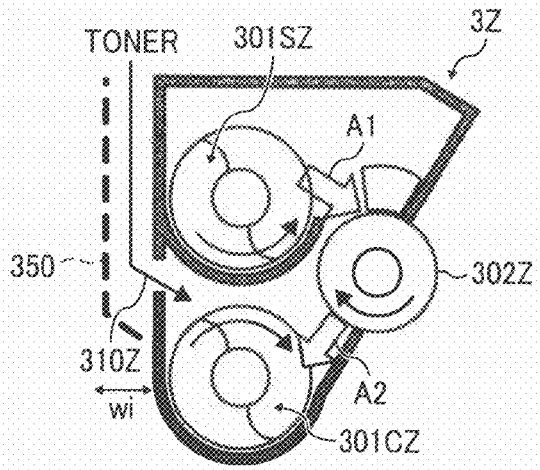
FIG. 17 RELATED ART
FIG. 17 is an end-on axial view of a development device of related art in which a developer collection compartment is disposed beneath a developer supply compartment and toner is supplied to the developer collection compartment.
Figure 18:
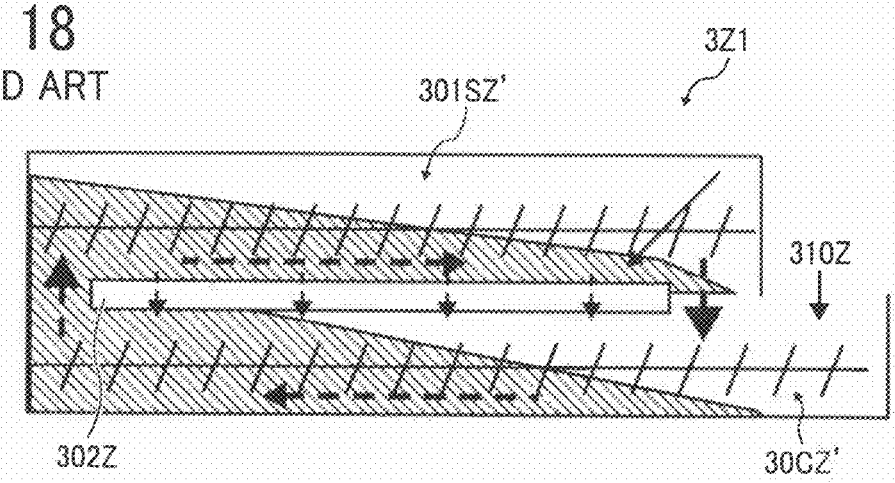
FIG. 18 RELATED ART
FIG. 18 is a cross-sectional view from a side of a development device of another related art in which a developer collection compartment is disposed beneath a developer supply compartment and toner is supplied to the developer collection compartment.

FIG. 16 is a schematic end-on axial view illustrating a configuration of developer circulation in the second variation.

Although developer is circulated in two separate developer conveyance paths, namely, the supply compartment and the collection compartment disposed beneath the supply compartment, in the above-described embodiment, in the developer circulation mechanism according to the second variation, developer is circulated in three separate developer conveyance paths. It is to be noted that the configuration of the developer circulation mechanism using three developer conveyance paths is not limited to that of the second variation.

The development device 3B according to the second variation includes a supply compartment 301S3 in which a first conveyance screw 304 is provided, a collection compartment 301C3 in which a second conveyance screw 305 is provided, and an agitation compartment 301A that receives developer from a downstream end portion of the supply compartment 301S3 and that of the collection compartment 301C3 and returns the developer to an upstream end portion of the supply compartment 301S3. In the agitation compartment 301A, a third conveyance screw 315 is provided. In the second variation, developer is transported in an identical or similar direction in the supply compartment 301S3 and the collection compartment 301C3, which is from the back side to the front side of the development device 3B. By contrast, in the agitation compartment 301A, developer is transported from the front side to the back side of the device, which is opposite the direction in which developer is transported in the supply compartment 301S3 and the collection compartment 301C3. Although not shown in FIG. 16, a communication port 309 is formed in a downstream end portion of the supply compartment 301S3 and communicates with an upstream end portion of the agitation compartment 301A, and a communication port connecting a downstream end portion of the collection compartment 301C3 and the upstream end portion of the agitation compartment 301A is provided as well.

More specifically, developer is circulated as follows in the second variation.

A first route is from the supply compartment 301S3 in which the first conveyance screw 304 is provided to the development roller 302, the collection compartment 301C3 in which the second conveyance screw 305 is provided, and the agitation compartment 301A in which the third conveyance member 315 is provided, and then returns to the supply compartment 301S3.

A second route is from the supply compartment 301S3 in which the first conveyance screw 304 is provided to the agitation compartment 301A in which the third conveyance member 315 is provided and then returns to the supply compartment 301S3.

Also in the second variation, the collection compartment 301C3 as well as the agitation compartment 301A are positioned beneath the supply compartment 301S3, and the developer transported to the downstream end portion of the supply compartment 301S3 is transported through the communication port 309 to the agitation compartment 301A. Additionally, a toner supply port 310 is provided in the downstream end portion of the supply compartment 301S3. Therefore, similarly to the above-described embodiment, to inhibit toner supplied through the toner supply port 310 from floating and moving to the development roller 302, an airflow path limiter such as the rib 311 shown in FIG. 9 is provided. Needless to say, the airflow path limiter is not limited to the rib 311, and alternatively, for example, the toner guide frame 313 according to the first variation may be used.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop a latent image formed on a latent image carrier with developer, the development device comprising:

a developer carrier disposed facing the latent image carrier, to carry the developer by rotation to a development area facing the latent image carrier;

a partition dividing an interior of the development device into a supply compartment and a collection compartment both facing the developer carrier and extending in an axial direction of the developer carrier, the supply compartment from which the developer is supplied to the developer carrier, having a downstream end portion positioned outside the development area in a developer conveyance direction in which the developer is circulated, in parallel to the axial direction of the developer carrier, the collection compartment disposed lower than the supply compartment, to which the developer is collected from the developer carrier;

a developer circulation unit to circulate the developer in the development device through a first communication port formed in a bottom portion of the downstream end portion of the supply compartment and a second communication port formed in an upstream end portion of the supply compartment, the developer circulation unit including a first developer conveyance member provided in the supply compartment, to supply the developer to the developer carrier while transporting the developer through the supply compartment and a second developer conveyance member disposed in the collection compartment facing the developer carrier, to transport the developer separated from the developer carrier;

a toner supply port formed in an upper portion of the downstream end portion of the supply compartment; and an airflow path limiter provided in the downstream end portion of the supply compartment and positioned closer to the development area than the toner supply port in the axial direction of the developer carrier, to restrict an airflow path above the developer in the downstream end portion of the supply compartment.

2. The development device according to claim 1, wherein the airflow path limiter is positioned on a side closer to the developer carrier in a direction horizontal and perpendicular to the axial direction of the developer carrier.

3. The development device according to claim 1, wherein the airflow path limiter is a rib formed in the supply compartment.

4. The development device according to claim 1, wherein the airflow path limiter comprises a toner guide forming a guide path for guiding toner supplied through the toner supply port downward.

5. The development device according to claim 4, wherein the toner guide is substantially rectangular in shape.

6. The development device according to claim 1, wherein the first developer conveyance member comprises a conveyance screw having a screw shaft and a spiral blade attached to the screw shaft to transport the developer in an axial direction thereof with rotation, and the spiral blade of the conveyance screw is not present in an area facing the airflow path limiter.

7. The development device according to claim 1, wherein the first developer conveyance member comprises a conveyance screw having a screw shaft and a spiral blade attached to the screw shaft to transport the developer in an axial direction thereof with rotation, and the spiral blade of the conveyance screw has a portion of reduced size located in an area facing the airflow path limiter.

8. The development device according to claim 1, wherein the first developer conveyance member comprises a conveyance screw having a screw shaft and a spiral blade attached to the screw shaft to transport the developer in an axial direction thereof with rotation, and the spiral blade of the conveyance screw is not present in a portion beneath the toner supply port.

9. The development device according to claim 1, wherein a face of the airflow path limiter on an upstream side in the developer conveyance direction is inclined to guide the developer toward a gap between the airflow path limiter and an inner wall of the supply compartment.

10. The development device according to claim 1, wherein the airflow path limiter reduces a length of the supply compartment in a direction horizontal and perpendicular to the axial direction of the developer carrier.

11. The development device according to claim 1, further comprising an agitation compartment disposed in parallel to the supply compartment and the collection compartment, the developer in the collection compartment is transported in a direction identical to the developer conveyance direction in the supply compartment, and the developer in the agitation compartment is transported in a direction opposite the developer conveyance direction in the supply compartment, and the developer is circulated from the downstream end portion of the supply compartment through the first communication port to an upstream end portion of the agitation compartment and from a downstream end portion of the agitation compartment through the second communication port to the upstream end portion of the supply compartment.

12. A process cartridge removably installable in an image forming apparatus, the process cartridge comprising:

a latent image carrier on which a latent image is formed; and a development device to develop the latent image with developer, the development device comprising:

a developer carrier disposed facing the latent image carrier, to carry the developer by rotation to a development area facing the latent image carrier;

a partition dividing an interior of the development device into a supply compartment and a collection compartment both facing the developer carrier and extending in an axial direction of the developer carrier, the supply compartment from which the developer is supplied to the developer carrier, having a downstream end portion positioned outside the development area in a developer conveyance direction in which the developer is circulated, in parallel to the axial direction of the developer carrier, the collection compartment disposed lower than the supply compartment, to which the developer is collected from the developer carrier;

a developer circulation unit to circulate the developer in the development device through a first communication port formed in a bottom portion of the downstream end portion of the supply compartment and a second communication port formed in an upstream end portion of the supply compartment, the developer circulation unit including a first developer conveyance member provided in the supply compartment, to supply the developer to the developer carrier while transporting the developer through the supply compartment and a second developer conveyance member disposed in the collection compartment facing the developer carrier, to transport the developer separated from the developer carrier;

a toner supply port formed in an upper portion of the downstream end portion of the supply compartment; and an airflow path limiter provided in the downstream end portion of the supply compartment and positioned closer to the development area than the toner supply port in the axial direction of the developer carrier, to restrict an airflow path above the developer in the downstream end portion of the supply compartment.

13. An image forming apparatus comprising:

a latent image carrier on which a latent image is formed; and a development device to develop the latent image with developer, the development device comprising:

a developer carrier disposed facing the latent image carrier, to carry the developer by rotation to a development area facing the latent image carrier;

a partition dividing an interior of the development device into a supply compartment and a collection compartment both facing the developer carrier and extending in an axial direction of the developer carrier, the supply compartment from which the developer is supplied to the developer carrier, having a downstream end portion positioned outside the development area in a developer conveyance direction in which the developer is circulated, in parallel to the axial direction of the developer carrier, the collection compartment disposed lower than the supply compartment, to which the developer is collected from the developer carrier;

a developer circulation unit to circulate the developer in the development device through a first communication port formed in a bottom portion of the downstream end portion of the supply compartment and a second communication port formed in an upstream end portion of the supply compartment, the developer circulation unit including a first developer conveyance member provided in the supply compartment, to supply the developer to the developer carrier while transporting the developer through the supply compartment and a second developer conveyance member disposed in the collection compartment facing the developer carrier, to transport the developer separated from the developer carrier;

a toner supply port formed in an upper portion of the downstream end portion of the supply compartment; and an airflow path limiter provided in the downstream end portion of the supply compartment and positioned closer to the development area than the toner supply port in the axial direction of the developer carrier, to restrict an airflow path above the developer in the downstream end portion of the supply compartment.

* * * * *